United States Patent [19]

Ferreri et al.

[11] Patent Number: 4,946,042

[45] Date of Patent: Aug. 7, 1990

[54] READILY OPENABLE COMBINATION SHIPPING AND DISPLAY CARTON

[75] Inventors: Paul Ferreri, Allendale; Heinz Maurer, Ridgefield, both of N.J.; Jennifer Kan, New York, N.Y.; Harry Allers, Oak Lawn; Michael Lackey, Geneva, both of Ill.

[73] Assignee: Lever Brothers Company, New York, N.Y.

[21] Appl. No.: 277,581

[22] Filed: Nov. 29, 1988

[51] Int. Cl.[5] ..... B65D 5/54

[52] U.S. Cl. ..... 206/628; 206/620; 206/622; 206/625

[58] Field of Search ..... 206/611, 614, 620, 622, 206/625, 628, 612, 629, 630, 427

[56] References Cited

U.S. PATENT DOCUMENTS

| | | | |
|---|---|---|---|
| 1,671,566 | 5/1928 | Baldwin | 206/630 |
| 1,717,367 | 6/1929 | Byrne | 206/625 |
| 2,153,340 | 4/1939 | Reid | 206/622 |
| 2,547,892 | 4/1951 | Stevens | 206/57 |
| 3,127,991 | 4/1964 | Burnett | 206/611 |
| 3,270,947 | 9/1966 | Rasmussen | 206/622 |
| 3,286,909 | 11/1966 | Scharre | 206/628 |
| 3,510,051 | 5/1970 | Nordstrom | 206/622 |
| 3,829,006 | 8/1974 | Spiegel | 229/51 |
| 4,058,206 | 11/1977 | Morse et al. | 206/44 |
| 4,216,861 | 8/1980 | Oliff | 206/427 |
| 4,398,636 | 8/1983 | Baxter | 206/614 |
| 4,478,334 | 10/1984 | Graser | 206/427 |
| 4,784,271 | 11/1988 | Wosaba, II et al. | 206/617 |

FOREIGN PATENT DOCUMENTS

| | | | |
|---|---|---|---|
| 719154 | 10/1965 | Canada | 206/611 |
| 758629 | 10/1956 | United Kingdom | 206/622 |
| 1141676 | 1/1969 | United Kingdom | 206/611 |
| 2008542 | 6/1979 | United Kingdom | 206/628 |

*Primary Examiner*—Gary E. Elkins

*Attorney, Agent, or Firm*—James J. Farrell

[57] ABSTRACT

A readily openable combination shipping and display carton and carton blank are disclosed. The carton is formed from a carton blank having a plurality of tearable lines of weakness such as perforation, perforation/-score and dividing lines. At least one removable panel or section is provided and may be removed by tearing along such lines of weakness which at least partially define the removable section. An opening for hand access to remove the removable section is also provided. Two side panel top flaps are provided with a plurality of portions and/or sections which maintain structural integrity and parallelism during shipping and handling and some of which are automatically removed along with removal of the removable section(s).

51 Claims, 3 Drawing Sheets

FIG. 2
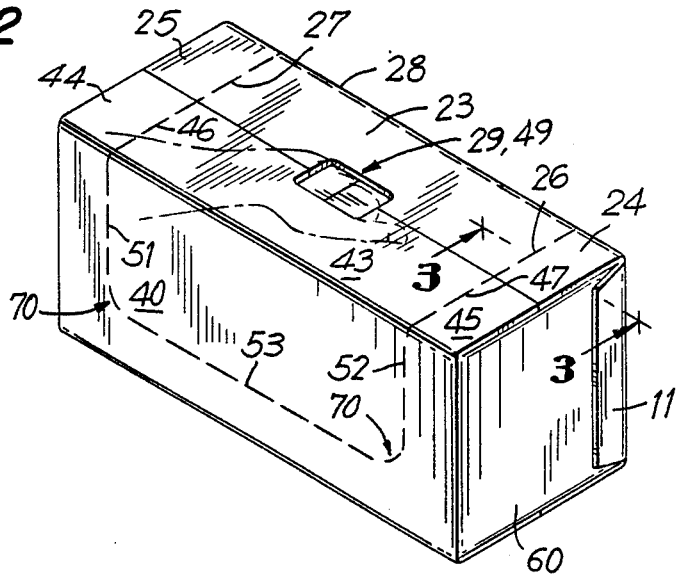
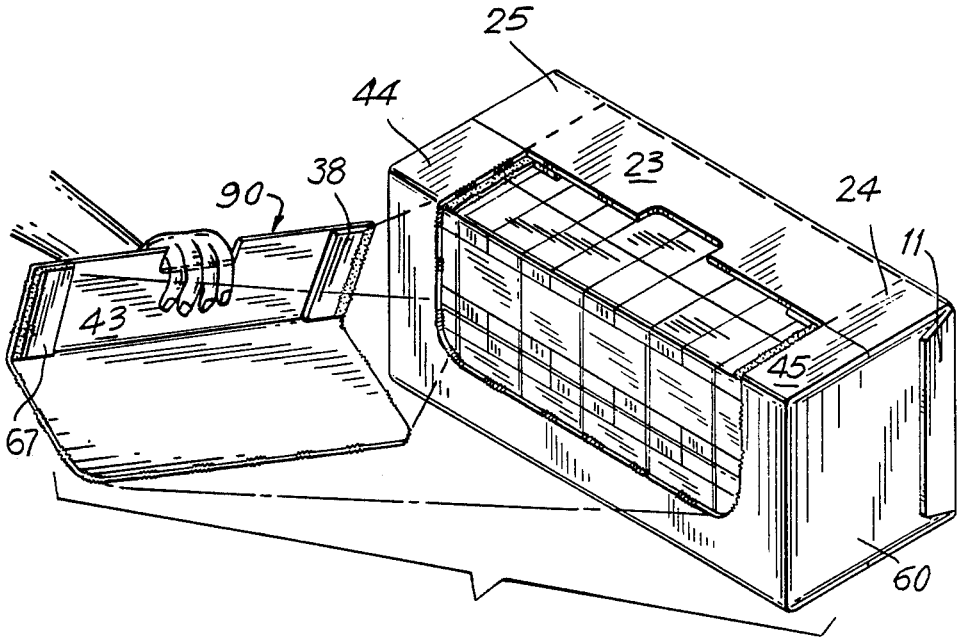
FIG. 4

READILY OPENABLE COMBINATION SHIPPING AND DISPLAY CARTON

FIELD OF THE INVENTION

This invention relates generally to cartons and more specifically to readily openable combination shipping and display cartons having tear out sections, removal of which enables both display and removal of articles contained therein. The cartons of this invention have exceptional structural stability which permits secure packing of heavy loads therein with little or no risk of accidental or unwanted premature opening thereof.

BACKGROUND OF THE INVENTION

Dual purpose shipping and display cartons having removable sections or panels defined by perforated tear lines are known. Such cartons are typically formed from a one-piece blank which has been suitably cut and scored to enable subsequent folding of the blank into a closed carton. The removable section(s) is generally defined by a plurality of perforated lines and may be separated from the closed carton by tearing out such section along the perforated lines.

The inclusion of perforation lines reduces the structural integrity of the cartons. Difficulty has been encountered in preventing inadvertent opening of the lines during storage or shipment. Unwanted opening of these lines exposes and subjects the articles contained therein to loss or theft, resulting in delayed or unfilled orders, spillage, and ultimately increased expense to consumers.

Inadvertent opening of the carton along the perforation lines depends largely on the stresses to which the filled cartons are subjected during handling and shipping. Stressful treatment of the cartons is to some extent uncontrollable, e.g., tall heavy stacks of the filled cartons are commonly needed or used for maximum efficient utilization of warehouse or cargo space, which develops high stress on the lower layers of the stacks. Also, inadvertent opening is especially likely during storage or shipment of relatively heavy articles.

The problem of inadvertent opening of perforation lines is compounded by the desire to employ as little carton material, i.e., carton weight, as possible, in the interest of materials cost savings. A reduction of the carton weight is accompanied by a diminution in carton strength and capability of containing articles without tearing, especially for articles of substantial weight. Thus, while cartons of lesser weight, i.e., less material, thinner panels and flaps, etc., are desirable from an economic point of view, as well as for ease of removing the removable sections, so are structurally strong and stable cartons which reliably contain the contents therein during shipping and handling. These objectives are at cross purposes and no combination shipping and display carton is known which optimally balances these competing objectives, especially for dense or heavy loads such a bar soaps.

The ratio of the weight of the contents of the carton to the weight of the carton may be viewed as a measure of packaging efficiency. Thus, higher ratios correspond to more efficient packaging. However, there are practical limits beyond which the carton strength is so low relative to the load that a reliable package is not feasible. Furthermore, this ratio is generally less for cartons having removable sections due to the inclusion of perforation lines, compared to the generally stronger cartons that can be fabricated without removable sections.

The difficulty of known dual purpose cartons in reliably containing high loads, especially articles of substantial density or weight such as bar soap, in a carton of minimum weight, is compounded by the desire for large removable sections. Large removable sections are desired to permit a substantial and attractive display of the articles and to facilitate removal of unit amounts thereof from retail shelves or counters by purchasers. However, large removable sections weaken correspondingly large portions of the relatively light weight carton.

SUMMARY OF THE INVENTION

The present invention provides a readily openable shipping and display carton which provides exceptional strength and reliability for packaging dense or heavy loads such as bar soap, and yet also includes large tear away portions which may easily be removed to open the carton for display of its contents with high visibility and access thereto.

Specifically, a carton blank is provided having a front, a rear and two side panels, each with integral top and bottom flaps. The carton blank is typically cut from a single piece of corrugated cardboard or other suitable carton material, scored to produce fold lines between adjacent panels and perforated to produce perforation and perforation/score lines which are eventually torn during separation of the removable panels for display of the articles within the carton. Dividing lines may also be, are preferably, formed in the carton blank.

A carton sleeve is formed by closing the blank onto itself so as to form a hollow sleeve, i.e., by fastening one end of the blank, illustratively the rear panel, to an opposite end of the blank, illustratively a side panel. The bottom flaps are then folded inwards and glued together to close the bottom of the carton. The top flaps are then also folded inward and glued together to close the top of the carton.

The perforation, perforation/score and dividing lines are configured such that at least one removable panel is provided and defined by such lines. The removable panel(s) includes part of the top of the carton as well as part of the front of the carton such that removal thereof displays and allows removal of the contents therein. The top of the carton is preferably formed from two side panel top flaps, a rear panel top flap and a front panel top flap.

Two removable panels are preferably provided. A first removable panel comprises a center section of the front panel top flap which extends into a section of the front panel. A second removable panel comprises a center section of the rear panel top flap. Removal of both sections provides a relatively large opening which affords a substantial display of the carton contents and easy removal of unit quantities thereof by consumers.

More specifically, one embodiment of the invention is a carton blank adapted to form a container comprising a rear panel having a rear panel top flap and a rear panel bottom flap, first and second side panels, each side panel having a top flap and a bottom flap, a front panel having a front panel top flap and a front panel bottom flap, and fastening means adapted for fastening the two free panels together so as to form a sleeve. The fastening means may be a glue flap which is glued to an outside surface of the sleeve.

The first side panel bottom flap is connected to the first side panel by a fold line and is divided by a perforation line, oriented approximately parallel to the fold line, into a first portion connected to the first side panel and a second portion.

The second side panel top flap is connected to the second side panel by a fold line and is divided by a perforation line, oriented approximately parallel to the fold line, into a first portion connected to the second side panel and a second portion.

In this embodiment, the second portion of the first side panel top flap and the second portion of the second side panel top flap are each preferably divided into a first section and a second section by a dividing line comprising a cut line having a nick and extending approximately perpendicularly from each of the perforation lines through each of the second portions.

The front panel top flap is preferably divided into a center section and two end sections by two perforation lines extending through the front panel top flap. These two perforation lines are approximately perpendicular to a fold line connecting the front panel top flap to the front panel. These two perforation lines also extend from the front panel top flap partially into the front panel and are preferably connected by a transverse perforation line. These two perforation lines extend into the front panel a substantial distance, in the range of about ½ to about ⅞ of the height of the front panel, and preferably about ¾ of such height. Alternatively, the distance into the front panel is in the range of about 4 to about 7 inches and preferably is about 5-3/16 inches for a specific embodiment discussed later herein. The transverse perforation line is connected to each of the two perforation lines by a curved perforation line having at least one curved skip.

The rear panel top flap is divided into a center section and two end sections by two perforation lines extending through the rear panel top flap. These two perforation lines are approximately perpendicular to a fold line connecting the rear panel top flap to the rear panel. These two perforation lines also extend to the fold line and are connected by a transverse perforation/score line along the fold line. The two perforation lines on the rear panel top flap are preferably coincident with the two perforation lines on the front panel top flap when the blank is folded so as to form a closed container.

Advantageously, the perforation lines on the front panel and rear panel top flaps are parallel to and offset from the perforation lines on the first side panel and second side panel top flaps when the blank is folded so as to form a closed container. The offsets are in a direction such that the distances from the fold lines between the first side panel and second side panel top flaps and the first and second side panels to the perforation lines on the first side panel and second side panel top flaps, respectively, are greater than the distances from the same fold lines to the perforation lines on the front panel and rear panel top flaps when the blank is folded so as to form a closed container. As a result, the first and second sections of the second portions of the first side panel and second side panel top flaps readily separate from and are removed from the first portions of said flaps, when the center sections of the rear panel and front panel top flaps are removed to open the carton and display its contents.

Glue may be used to join all portions of the two side panel top flaps to the front and rear panel top flaps, in which case removal of the center section of the rear panel top flap also removes one of the first and second sections of the first side panel top flap and one of the first and second sections of the second side panel top flap. Similarly, removal of the center section of the front panel top flap also removes one of the first and second sections of the first side panel top flap and one of the first and second sections of the second side panel top flap.

The front panel top flap and the rear panel top flap are preferably each provided with a notch such that when the blank is folded so as to form a closed container the two notches are adjacent, thereby forming a single larger opening which provides hand access into the closed container.

Each of the perforation lines in the front panel top flap, rear panel top flap, front panel, first side panel top flap and second side panel top flap comprises a plurality of successive perforation sections, each perforation section comprising a cut followed by a skip. The cut is illustratively in the range of approximately ¼ to approximately 1 inch long and the skip is illustratively in the range of approximately 1/16 to approximately ⅜ inch long. Preferably, the cut is approximately ½ inch long and the skip is approximately 3/16 inch long.

The transverse perforation/score line also comprises a plurality of successive perforation sections. The cut and the skip are each illustratively in the range of approximately 1/16 to approximately ½ inch long. Preferably, they are each approximately ¼ inch long.

An illustrative ratio of the width of the center section to the width of each of the end sections is in the range of about 2:1 to about 16:1, and is preferably about 5:1. Alternatively, an illustrative width of each end section is in the range of about ¾ to about 3 inches with about 2½ inches being preferable.

The presently preferred embodiment of the invention may be constructed from corrugated cardboard having a weight of approximately 12 ounces. Such a carton has been employed to reliably ship and display bar soap contents weighing over 23 pounds, providing a contents-to-carton weight ratio of at least about 30 to 1. Further, the presently preferred embodiment of the invention may be employed to ship and display articles weighing up to about 50 pounds, providing a contents-to-carton weight ratio in excess of 65.

Therefore, it is a principal object of the present invention to provide a readily openable combination shipping and display carton.

A further object of the invention is to provide a combination shipping and display carton of minimum weight which reliably contains relatively heavy articles during shipping and handling.

Another object of the invention is to provide a combination shipping and display carton having a relatively large contents-to-carton weight ratio.

A further object of the invention is to provide a combination shipping and display carton having relatively large removable sections which enable highly visible display and removal of articles therein.

A still further object of the invention is to provide a combination shipping and display carton having removable sections defined by a combination of straight and curved perforation lines.

Another object of the invention is to provide a combination shipping and display carton having a removable section wherein removal thereof is accompanied by removal of a section of top side flaps which provides rigidity to the carton during shipping and handling.

BRIEF DESCRIPTION OF THE DRAWINGS

These and other objects, features and advantages of the present invention will become more readily apparent from the following detailed description of the invention in which:

FIG. 2 is a perspective view of the carton blank in a folded closed state;

FIG. 4 is a perspective view of the carton of FIG. 2 having a removable section removed and displaying articles therein;

DETAILED DESCRIPTION OF THE INVENTION

Figure 1:
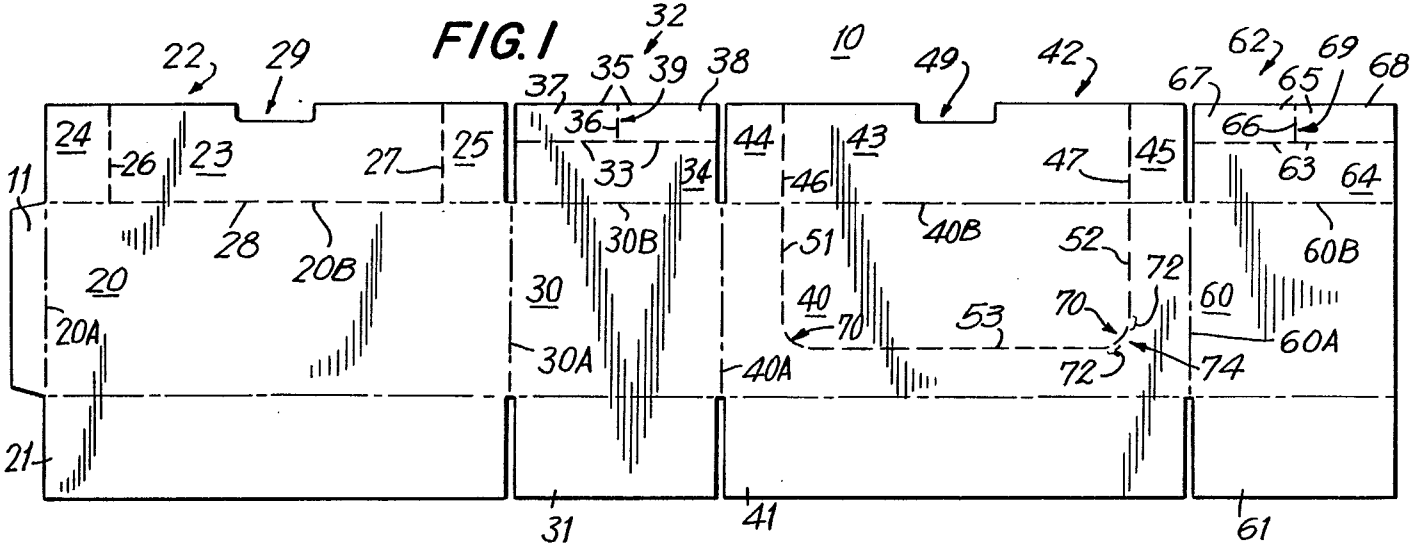
FIG. 1 illustrates the carton blank of the present invention in a flat unfolded state.

Referring to FIG. 1, there is depicted, in a flat unfolded state, a carton blank 10 of the presently preferred embodiment of the invention. Blank 10 comprises a rear panel 20, a first side panel 30, a front panel 40 and a second side panel 60.

Rear panel 20 is integrally formed with a rear panel bottom flap 21 and a rear panel top flap 22. Rear panel top flap 22 is divided into a center section 23 and two end sections 24, 25 by two perforation lines 26, 27. Rear panel 20 is also provided with a transverse perforation/-score line 28 which segregates center section 23 from rear panel 20. Transverse perforation/score line 28 extends from one end of perforation line 26 to a corresponding end of perforation line 27 along a fold line 20B between rear panel 20 and rear panel top flap 22. Rear panel top flap 22 is provided with an opening, or notch, 29. Rear panel 20 is also joined by a fold line to rear panel bottom flap 21.

First side panel 30 is connected to rear panel 20 along a fold line 30A and is integrally formed with a first side panel bottom flap 31 and a first side panel top flap 32. First side panel top flap 32 is divided by a perforation line 33 into a first portion 34 connected to first side panel 30 along a fold line 30B and a second portion 35. Perforation line 33 is preferably parallel to the fold line 30B between top flap 32 and first side panel 30. A dividing line 36 extends perpendicularly from the center of perforation line 33 and divides second portion 35 into a first section 37 and a second section 38.

Front panel 40 is connected to first side panel 30 along fold line 40A and is integrally formed with a front panel bottom flap 41 and a front panel top flap 42. Front panel top flap 42 is divided into a center section 43 and two end sections 44, 45 by two perforation lines 46, 47. Perforation lines 46, 47 extend from an outside edge of top flap 42 to a fold line 40B connecting top flap 42 to front panel 40. Front panel top flap 42 is provided with an opening, or notch, 49.

Front panel 40 is also provided with two further perforation lines 51, 52 which join perforation lines 46, 47, respectively, at the fold line 40B connecting top flap 42 to front panel 40. Perforation lines 51, 52 extend from this fold line into front panel 40 and are joined together therein. Perforation lines 51, 52 are joined together by a transverse perforation line 53.

Second side panel 60 is connected to front panel 40 along a fold line 60A and is integrally formed with a second side panel bottom flap 61 and a second side panel top flap 62. Second side panel top flap 62 is divided by a perforation line 63 into a first portion 64 connected to second side panel 60 along a fold line 60B and a second portion 65. The perforation line dividing second side panel top flap 62 into two portions is preferably parallel to the fold line 60B connecting top flap 62 to side panel 60. A dividing line 66 extends perpendicularly from the center of perforation line 63 and divides second portion 65 into a first section 67 and a second section 68. Thus, second side panel 60 and its top and bottom flaps are identical in geometry to first side panel 30 and its top and bottom flaps, such side panels being joined in flanking position to front panel 40 along fold lines 40A and 60A.

Blank 10 preferably is further provided with means for fastening together opposite panels so as to form a sleeve. As depicted in FIG. 1, blank 10 includes such fastening means in the form of a glue flap 11 which extends from rear panel 20 along a fold line 20A. Glue flap 11 is adapted for fastening rear panel 20 to second side panel 60 and is preferably glued to an outside surface of second side panel 60 (see FIG. 3).

The perforation, perforation/score and dividing lines shown in the figures may have a variety of specific configurations. Each of these lines is essentially a line of relative weakness in the material from which the carton is constructed. Illustratively, the perforation and transverse perforation lines 26, 27, 46, 47, 51, 52 and 53 are identical and comprise a plurality of successive perforation sections, each perforation section comprising a cut followed by a skip. A cut is a penetration or a series of penetrations through or substantially through the thickness of the carton blank. A skip is an uncut length in the carton. Cuts and skips may be straight or curved.

Suitable lengths for the cut and the skip in the above referenced perforation lines are approximately $\frac{1}{4}$ to approximately 1 inch long for the cut and approximately 1/16 to approximately $\frac{3}{8}$ inch long for the skip. Preferable lengths are approximately $\frac{1}{2}$ inch long for the cut and approximately 3/16 inch long for the skip.

The perforation/score line 28 is a perforation line placed along fold line 20B and also comprises a plurality of successive perforation sections, each perforation section comprising a cut followed by a skip.

Suitable lengths for the cut and the skip in the perforation/score line 28 are approximately 1/16 to approximately $\frac{1}{2}$ inch long for both the skip and the cut. Preferable lengths are approximately $\frac{1}{4}$ inch for both the skip and the cut.

The dividing lines 36 and 66 preferably comprise a single cut having a single short nick section (39 in dividing line 36; 69 in dividing line 66) which is not cut. Advantageously, nicks 39, 69 stabilize the parallelism of the first and second sections of each of the side panel top flaps during processing and handling in the packaging machinery line. Alternatively, the dividing line may comprise a perforation line.

The transverse perforation line may be joined to the two perforation lines in the front panel in a variety of ways. However, use of curved perforation lines, i.e., corners, has been found to be necessary for reliably packaging bar soaps in the carton, particularly if the transverse perforation line is perpendicular to the two perforation lines as in the presently preferred embodiment depicted in FIG. 1. In this embodiment, each of the curved corners 70 comprise at least one curved skip 72. Each of curved corners 70 preferably also comprises at least one curved cut 74.

Referring now to FIG. 2, there is depicted the carton blank of the present invention in a closed or folded state. The blank is formed into a closed carton by gluing glue flap 11 to the free end of second side panel 60 so as to form a hollow sleeve. Bottom flaps 31, 61 are then folded ninety degrees inward and glue applied thereto, followed by folding bottom flaps 21, 41 ninety degrees inward, over and into contact with flaps 31, 61 in order to become adhesively joined thereto. Top flaps 32, 62 are folded ninety degrees inward and glue applied thereto, taking care not to place glue in areas of offset, or overlap, between superimposed end sections 24 and 25, on the one hand, and end sections 44 and 45, on the other, as will be more fully explained in discussion of FIG. 3. Top flaps 22, 42 are then folded ninety degrees inward and glued to top flaps 32, 62 so as to form a closed container.

As will be appreciated, two removable sections, or panels, are defined by perforation and perforation/score lines 26, 27, 28, 46, 47, 51, 52 and 53. Specifically, a first removable section is defined by perforation lines 46 and 51, transverse perforation line 53, corners 70, and perforation lines 47 and 52. A second removable section is defined by perforation lines 26 and 27, and perforation/-score line 23.

Notch 29 in rear panel top flap 22 and notch 49 in front panel top flap 42 are configured so as to be adjacent to each other when the carton is in its closed configuration, as depicted in FIG. 2, thereby providing hand access into the closed carton to facilitate tearing away of the removable sections.

Although cartons constructed in accordance with the invention may have any practical size or shape, the internal measurements of the preferred embodiment depicted in FIG. 2 are as follows:

| | |
|---|---|
| height (measured vertically) | 7½ inches |
| width (measured in a direction parallel to line 28) | 17⅝ inches |
| depth (measured in a direction parallel to line 26) | 7-15/16 inches. |

Figure 3:
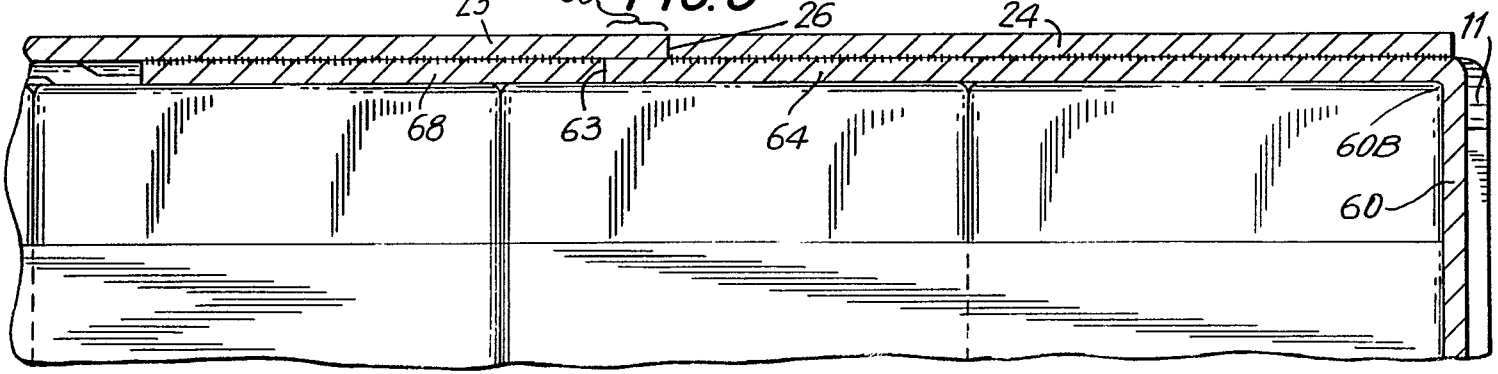
FIG. 3 is a partial cross-sectional view of FIG. 2 along line 3—3.

FIG. 3 is a partial cross-sectional view of FIG. 2 along line 3—3 and depicts an offset, or overlap 80, in the preferred embodiment. Overlap 80 exists since the distance (D1) from the fold line 60B between second side panel 60 and second side panel top flap 62 to perforation line 63 is greater than the distance (D2) from such fold line to perforation lines 26 and 47 after assembly of the carton. Although any suitable width may be employed for the offset, depending on the nature and the packing configuration of the articles within the cartons, a width on the order of ⅛ inch has been found acceptable. Alternatively, an offset may not be employed and perforation line 63 may be in line with perforation lines 26, 47. Advantageously, by extending D1 beyond D2 and thereby providing an offset, a more rigid parallelogram is formed to increase the structural integrity of the carton, especially during shipment. The offset also ensures that the first and second sections 37, 38, 67 and 68 of the top flaps 34 and 64 will separate cleanly, together with the removable tear away sections provided in the top flaps 22, 42 and front panel 40, and without interference or obstruction by first and second portions 34 and 64 of the top flaps 32 and 62, when such sections are removed to display the carton contents.

A similar offset is provided in the area between perforation line 33 and perforation lines 27, 46 to match the structural and functional relationships discussed above with respect to offset 80.

As will be appreciated, the first and second sections 37 and 38 of first side panel top flap 32 and the first and second sections 67 and 68 of second side panel top flap 62 contribute to the structural integrity and rigid parallelism of the closed carton during shipping, handling and the like.

Referring now to FIG. 4, there is depicted the carton of the present invention with the removable section 90, comprising center section 43 and the area of front panel 40 circumscribed by perforation lines 51, 52 and 53, removed to display articles contained within the carton. In particular, the articles are each two bars of soap taped together, with each bar weighing about 4.75 ounces. Although cartons may be constructed to ship and display any practical number of articles of any suitable size, the preferred embodiment depicted in FIG. 4 contains thirty-six of the two-bar articles.

Application of force to the underside of center section 43 in an area near opening 49 will cause the portion of perforation line 63 (FIGS. 1, 3) between first portion 64 and first section 67 to tear. Additionally, nick 69 in dividing line 66 will tear, enabling separation of the first and second sections 67, 68. Such application of force will also simultaneously cause perforation line 47 (FIG. 1) between center section 43 and end section 45 to tear. Alternatively, first section 67 is not glued to center section 43, and application of force to the area near opening 49 will cause only perforation line 47 to tear and not perforation line 63. In such an embodiment, first section 67 will remain attached to first portion 64 along perforation line 63 as panel 90 is removed. First section 67 may then be separately and directly removed by hand. These actions will also occur at the opposite side of center section 43, with respect to the corresponding parts, i.e., first section 37, first portion 34, the perforation line 33, and nick 39.

End section 44, first portion 34 and second section 38 are connected to each other and to center section 43, as are end section 45, first portion 64 and first section 67, to provide completely boxed corners remaining at the junctions of the front panel, front panel top flaps and side panel top flaps at the upper front corners of the carton after removal of section 90. This contributes continuing strength and rigidity in the overall carton structure after it has been opened to display its contents.

Figure 5:
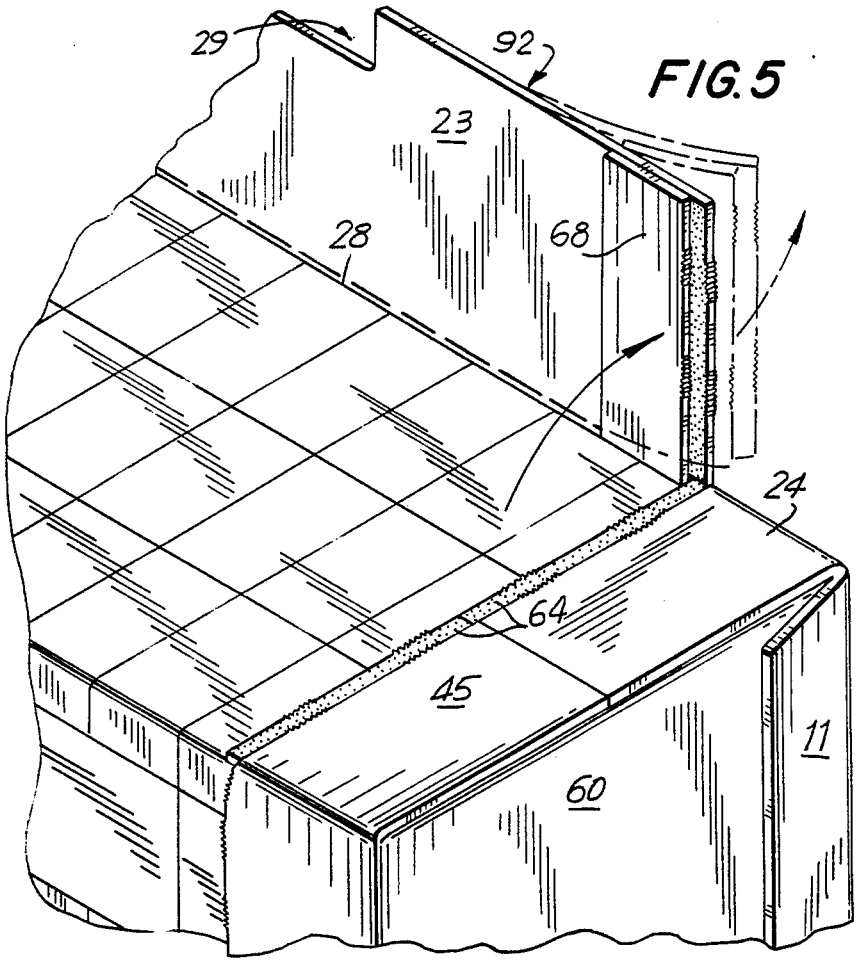
FIG. 5 is a perspective view of the carton of FIG. 4 having a further removable section partially removed.

FIG. 5 depicts the carton having the first removable section completely removed and a second removable section 92 partially removed. The second removable section 92 is the center section 23 of the rear panel top flap circumscribed by the perforation lines 26, 27 and perforation/score line 28. Specifically, application of force to the underside of center section 23 in an area near opening 29 will cause the portion of perforation line 63 (FIGS. 1, 3) between first portion 64 and second section 68 to tear. Such application of force will also simultaneously cause perforation line 26 (FIGS. 1, 3) between center section 23 and end section 24 to tear. Alternatively, second section 68 is not glued to center section 23, and application of force to the area near opening 29 will cause only perforation line 26 to tear and not perforation line 63. Thus, in such an embodiment, second section 68 will remain attached to first portion 64 along perforation line 63 as the second removable section 92 is removed. Second section 68 may thereafter be separately and directly removed by hand. Again, these actions also occur at the opposite end of center section 23 with respect to the corresponding parts, second section 38, perforation line 33, and first portion 34.

Once removable section 92 is partially removed as shown in FIG. 5, further application of force to the end of center section 23 near second section 68, as indicated by the dashed arrow, will tear perforation/score line 28 and completely remove section 92. Alternatively, this force may be applied at the an opposite end of center section 23 near second section 38.

Figure 6:
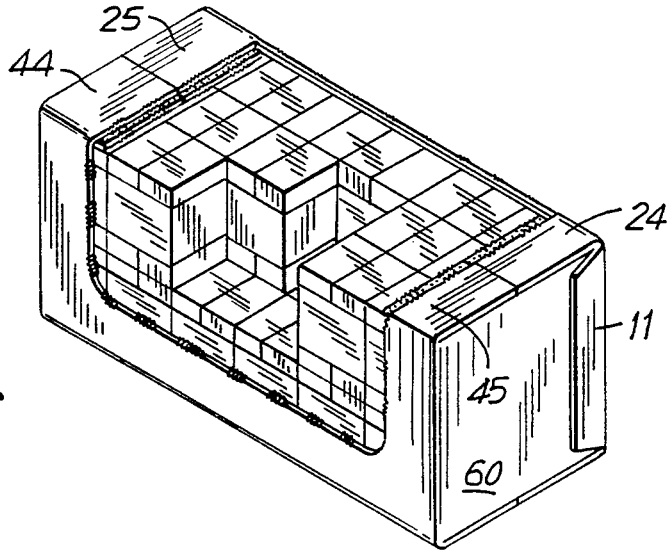
FIG. 6 is a perspective view of the carton of FIG. 5 having the further removable section completely removed and having some of the displayed articles removed.

FIG. 6 depicts the carton of the present invention with both removable sections removed. As shown, three of the two-bar soap articles have also been removed. End section 25, first portion 34 and first section 37 are connected to each other and to center section 23, as are end section 24, first portion 64 and second section 68. As a result, all of the four corners at the front, top and rear of the opened carton are completely boxed in to provide continuing strength and rigidity. At the same time, a large access opening is provided through which the carton contents may be both attractively displayed and readily removed by consumers.

While it is apparent that the invention herein disclosed is especially effective to fulfill the objects stated above, it will be appreciated that numerous modifications and embodiments may be devised by those skilled in the art, and it is intended that the appended claims cover all such modifications and embodiments as fall within the spirit and scope of the present invention.

What is claimed is:

1. A carton blank adapted to form a container comprising:

a rear panel having a rear panel top flap and a rear panel bottom flap, a first side panel connected to said rear panel and having a first side panel top flap and a first side panel bottom flap, said first side-panel top flap being connected to said first side panel by a fold line and being divided by a perforation line, oriented approximately parallel to said fold line, into a first portion connected to said first side panel and a second portion, a front panel connected to said first side panel and having a front panel top flap and a front panel bottom flap, said front panel top flap being divided into a center section and two end sections by two perforation lines extending through said front panel top flap, said two perforation lines being approximately perpendicular to a fold line connecting said front panel top flap to said front panel, and said two perforation lines extending from said front panel top flap partially into said front panel and being connected by a transverse perforation line, a second side panel connected to said front panel and having a second side panel top flap and a second side panel bottom flap, said second side panel top flap being connected to said second side panel by a fold line and being divided by a perforation line, oriented approximately parallel to said fold line, into a first portion connected to said second side panel and a second portion, and fastening means adapted for fastening said rear panel and said second side panel together so as to form a sleeve, wherein said second portion of said first side panel top flap and said second portion of said second side panel top flap are each divided into a first section and a second section by a dividing line extending approximately perpendicularly from each said perforation line through each said second portion.

2. The blank of claim 1 wherein said transverse perforation line is connected to each of said two perforation lines by a curved perforation line having at least one curved skip.

3. The blank of claim 2 wherein said rear panel top flap is divided into a center section and two end sections by two perforation lines extending through said rear panel top flap, said two perforation lines being approximately perpendicular to a fold line connecting said rear panel top flap to said rear panel, said two perforation lines extending to said fold line and being connected by a transverse perforation/score line along said fold line.

4. The blank of claim 3 wherein said two perforation lines on said rear panel top flap are coincident with said two perforation lines on said front panel top flap when said blank is folded so as to form a closed container.

5. The blank of claim 4 wherein said perforation lines on said front panel and rear panel top flaps are parallel to and offset from said perforation lines on said first side panel and second side panel top flaps when said blank is folded so as to form a closed container, said offsets being in a direction such that the distances from the fold lines between said first side panel and second side panel top flaps and said first and second side panels to the perforation lines on said first side panel and second side panel top flaps are greater than the distances from said same fold lines to the perforation lines on said front panel and rear panel top flaps when said blank is folded so as to form a closed container.

6. The blank of claim 3 wherein said front panel top flap and said rear panel top flap are each provided with a notch such that when said blank is folded so as to form a closed container said two notches are adjacent, thereby forming a single larger opening which provides hand access into the closed container.

7. The blank of claim 3 wherein each of said perforation lines in said front panel top flap, rear panel top flap, front panel, first side panel top flap and second side panel top flap comprises a plurality of successive perforation sections, each perforation section comprising a cut followed by a skip.

8. The blank of claim 7 wherein said cut is in the range of approximately $\frac{1}{4}$ to approximately 1 inch long and said skip is in the range of approximately 1/16 to approximately $\frac{3}{8}$ inch long.

9. The blank of claim 7 wherein said cut is approximately $\frac{1}{2}$ inch long and said skip is approximately 3/16 inch long.

10. The blank of claim 3 wherein said transverse perforation/score line comprises a plurality of successive perforation sections, each perforation section comprising a cut followed by a skip.

11. The blank of claim 10 wherein said cut and said skip are each in the range of approximately 1/16 to approximately $\frac{1}{2}$ inch long.

12. The blank of claim 10 wherein said cut and said skip are each approximately $\frac{1}{4}$ inch long.

13. The blank of claim 1 wherein each of said dividing lines is a cut line having a nick.

14. The blank of claim 1 wherein said fastening means is a glue flap.

15. The blank of claim 14 wherein said glue flap is gluable to an outside surface of said sleeve.

16. The blank of claim 1 wherein the ratio of the width of the center section to the width of each said end section is in the range of about 2:1 to about 16:1.

17. The blank of claim 1 wherein the ratio of the width of the center section to the width of each said end section is approximately 5:1.

18. The blank of claim 1 wherein the width of each end section is in the range of about ¾ to about 3 inches.

19. The blank of claim 1 wherein the width of each end section is approximately 2½ inches.

20. An improved carton adapted to contain, display and allow removal of a plurality of articles and having a front panel, a rear panel, a first side panel and a second side panel, each of said panels having a top flap and a bottom flap adapted to be folded over to form a top and a bottom of said carton, respectively, wherein the improvement comprises:

a first pair of perforation lines extending perpendicularly from a first fold line between said rear panel and said rear panel top flap through said rear panel top flap thereby dividing said rear panel top flap into a center section and two end sections, said first pair of perforation lines being connected by a transverse perforation/score line extending along said first fold line, a second pair of perforation lines extending perpendicularly from a second fold line between said front panel and said front panel top flap through said front panel top flap thereby dividing said front panel top flap into a center section and two end sections, each said end section having a width measured along said second fold line approximately the same as the width of each of said two end sections of said rear panel top flap measured along said first fold line.

a third pair of perforation lines extending from said second pair of perforation lines at said second fold line a substantial distance into said front panel, said third pair of perforation lines being joined by a transverse perforation line, a first perforation line extending through said first side panel top flap approximately parallel to a third fold line between said first side panel top flap and said first side panel, said first perforation line being at a predetermined distance from said third fold line and dividing said first side panel top flap into a first portion connected to said third fold line and a second portion, a first dividing line extending perpendicularly from said first perforation line through said second portion of said first side panel top flap and dividing said second portion into a first section and a second section, a second perforation line extending through said second side panel top flap approximately parallel to a fourth fold line between said second side panel top flap and said second side panel, said second perforation line being spaced from said fourth fold line by a distance equal to said predetermined distance from said third fold line to said first perforation line and dividing said second side panel top flap into a first portion joined to said third fold line and a second portion, and a second dividing line extending perpendicularly from said second perforation line through said second portion of said second side panel top flap and dividing said second portion into a first section and a second section.

21. The carton of claim 20 wherein said end sections of said front panel and rear panel top flaps have equal widths and are approximately equal to said predetermined distance.

22. The carton of claim 20 wherein said end sections of said front panel and rear panel top flaps have equal widths, each said width being less than said predetermined distance.

23. The carton of claim 20 wherein each perforation line forming said third pair of perforation lines is joined to opposite ends of said transverse perforation line by a curved perforation line having at least one curved skip.

24. The carton of claim 20 wherein each of said front panel and rear panel top flaps is provided with an opening such that when said flaps are closed to form a closed container, said openings are adjacent and form a single larger opening which provides hand access into the closed container.

25. The carton of claim 24 wherein portions of inside surfaces of said front panel and rear panel top flaps are glued to outside surfaces of said first side panel and second side panel top flaps.

26. The carton of claim 25 wherein said center section of said rear panel top flap is defined by said first pair of perforation lines and said transverse perforation/score line and is readily removable from said container by exerting force to an area surrounding said opening in said rear panel top flap and removing said center section along said first pair of score lines and said transverse perforation/score line.

27. The carton of claim 26 wherein removal of said center section of said rear panel top flap also removes one of said first and second sections of said first side panel top flap and one of said first and second sections of said second side panel top flap.

28. The carton of claim 25 wherein a tear out section is defined by said second pair of perforation lines and said third pair of perforation lines and said transverse perforation line, said tear out section being readily removable from said container by exerting force to an area surrounding said opening in said front panel top flap and removing said tear out section along said second pair of perforation lines, said third pair of perforation lines and said transverse perforation line.

29. The carton of claim 28 wherein removal of said tear out section also removes one of said first and second sections of said first side panel top flap and one of said first and second sections of said second side panel top flap.

30. The carton of claim 20 wherein each of said first and said second dividing lines is a cut line having a nick.

31. The carton of claim 20 wherein each of said first, second and third pairs of perforation lines and said transverse perforation line comprises a plurality of successive perforation sections, each perforation section comprising a cut followed by a skip.

32. The carton of claim 31 wherein said cut is in the range of approximately ¼ to 1 inch long and said skip is in the range of approximately 1/16 to ⅜ inch long.

33. The carton of claim 31 wherein said cut is approximately ½ inch long and said skip is approximately 3/16 inch long.

34. The carton of claim 20 wherein said transverse perforation/score line comprises a plurality of successive perforation sections, each perforation section comprising a cut followed by a skip.

35. The carton of claim 34 wherein said cut and said skip are each in the range of approximately 1/16 to ½ inch long.

36. The carton of claim 34 wherein said perforation and said skip are each approximately ¼ inch long.

37. The carton of claim 20 wherein the widths of said center sections are equal, the ratio of each said width to the width of each said end section being in the range of about 2:1 to about 16:1.

38. The carton of claim 37 wherein said ratio is approximately 5:1.

39. The carton of claim 20 wherein the width of each said end section is in the range of about ¾ to about 3 inches.

40. The carton of claim 20 wherein the width of each said end section is approximately 2½ inches.

41. The carton of claim 20 further comprising an external glue flap for fastening one of said front and rear panels to one of said first and second side panels to form a sleeve.

42. The carton of claim 20 wherein said substantial distance into said front panel is in the range of about ½ to about ⅞ of the distance between said second fold line and a fifth fold line between said front panel and said front panel bottom flap.

43. The carton of claim 42 wherein said substantial distance is ¾ of the distance between said second fold line and said fifth fold line.

44. The carton of claim 20 wherein said substantial distance into said front panel is in the range of about 4 to about 7 inches.

45. The carton of claim 44 wherein said substantial distance is about 5 3/16 inches.

46. A display carton comprising:

a rear panel having a rear panel top flap connected thereto by a fold line, said rear panel top flap having a rear transverse edge;

a first side panel connected to said rear panel and having a first side panel top flap connected to said first side panel by a fold line, a front panel connected to said first side panel and having a front panel top flap connected to said front panel by a fold line, said front panel top flap having a front transverse edge, and a second side panel connected to said front panel and having a second side panel top flap connected to said second side panel by a fold line, wherein said front panel and said front panel top flap are provided with a first tear out section defined by a first pair of perforation lines extending forwardly from the front transverse edge of said front panel top flap to said fold line between said front panel top flap and said front panel, then into and being connected together within said front panel so as to form a continuous perforation line having a plurality of cuts and skips; wherein said rear panel top flap is provided with a second tear out section defined by a second pair of perforation lines extending rearwardly from the rear transverse edge of said rear panel top flap to said fold line between said rear panel top flap and said rear panel and being connected together along said fold line by a transverse perforation/score line; whereby removal of said first and second tear out sections provides a substantial access opening through which contents of said display carton may be both displayed and easily removed.

47. The carton of claim 46 wherein said first side panel top flap and said second side panel top flap are each provided with a perforation line and a dividing line to define first, second and third segments thereof, said first segments being joined by an adhesive to said first tear out section and being removed therewith, said second segments being joined by an adhesive to said second tear out section and being removed therewith, and said third segments being joined by an adhesive to both said front panel and rear panel top flaps.

48. The carton of claim 47 further comprising glue flap means for fastening one of said front and rear panels to one of said first and second side panels to form a sleeve.

49. The carton of claim 46 wherein said continuous perforation line comprises a plurality of straight cuts and straight skips and a plurality of curved cuts and curved skips.

50. The carton of claim 47 wherein each said dividing line comprises a cut line having a nick.

51. The carton of claim 46 wherein at least one of said rear panel and front panel top flaps is notched to provide hand access into the closed carton.

* * * * *